United States Patent [19]

Kohmura et al.

[11] 4,020,232

[45] Apr. 26, 1977

[54] HEAT-SENSITIVE RECORDING SHEETS

[75] Inventors: Isao Kohmura; Kiyoshi Futaki; Kozo Haino, all of Nagaokakyo, Japan

[73] Assignee: Mitsubishi Paper Mills, Ltd., Tokyo, Japan

[22] Filed: May 14, 1975

[21] Appl. No.: 577,594

[30] Foreign Application Priority Data

May 17, 1974 Japan ..... 49-54572
May 18, 1974 Japan ..... 49-55989

[52] U.S. Cl. ..... 428/411; 427/150; 427/151; 427/152; 428/913; 428/914

[51] Int. Cl.[2] ..... B41M 5/18

[58] Field of Search ..... 427/146, 148, 150, 151, 427/152; 428/411, 913, 537, 914; 282/27.5

[56] References Cited

UNITED STATES PATENTS

| | | | |
|---|---|---|---|
| 2,675,332 | 4/1954 | Green | 428/411 |
| 3,185,583 | 5/1965 | Baumann et al. | 428/913 |
| 3,473,945 | 10/1969 | Futaki | 428/913 |
| 3,632,379 | 1/1972 | Wiese | 428/913 |
| 3,664,858 | 5/1972 | Huffman | 428/913 |

*Primary Examiner*—Thomas J. Herbert, Jr.
*Assistant Examiner*—Bruce H. Hess
*Attorney, Agent, or Firm*—Cushman, Darby & Cushman

[57] ABSTRACT

This invention discloses a heat-sensitive recording sheet which comprises a support and, coated thereon, a heat-sensitive composition containing an organic base and at least one acylated lactone or sultone type acidic leuco dye capable of forming a color by reaction with said organic base at an elevated temperature. The invention further discloses as one embodiment a multicolor heat-sensitive recording sheet prepared by adding to the above-mentioned chromogenic system a chromogenic system comprising a normally solid phenolic substance and at least one basic chromogenic substance capable of forming a color by reaction with said phenolic substance at an elevated temperature. Preferable examples of the above-mentioned leuco dye are acrylated xanthene lactone type leuco dyes.

17 Claims, No Drawings

HEAT-SENSITIVE RECORDING SHEETS

This invention relates to a heat-sensitive recording sheet. More particularly, the invention pertains to a heat-sensitive recording sheet characterized by containing an organic base and an acylated lactone or sultone type acidic leuco dye cabable of forming a color by reaction with said organic base at an elevated temperature. The invention further pertains, as one embodiment thereof, to a multicolor heat-sensitive recording sheet containing a normally solid phenolic substance, a basic chromogenic substance capable of forming a color by reaction with said phenolic substance at an elevated temperature, a normally solid organic base, and an acylated lactone or sultone type acidic leuco capable of forming a color by reaction with said organic base at an elevated temperature.

Heat-sensitive recording sheets using pH indicators such as phenolphthalein or Cresol Red which can develop colors by reaction with alkali-generating agents have already been proposed hitherto. As the alkali-generating agents used in said heat-sensitive recording sheets, there have been known substances capable of generating ammonia by thermal decomposition such as urea and ammonium salts or organic acids; salts obtained by neutralization of basic substances such as triethanolamine with heat-decomposable acids such as trichloroacetic acid; complexes of amines with bisphenols; and salts such as solium carbonate and sodium stearate. These substances, however, are not preferable for use in heat recording sheets because they decompose gradually even at normal temperature to bring about causes for contamination of recording sheets during storage; are so slow in thermal decomposition rate that extremely high temperatures are required for promotion of the decomposition rates; are so water-soluble that in an aqueous system, they form colors even without application of heat, and hence cannot be used in an aqueous system; or can be synthesized with extreme difficulty.

On the other hand, the organic bases used in the present invention do not generate alkalis by thermal decomposition but melt at the melting points of the crystalline organic bases in a finely dispersed state, thereby making the atmosphere alkaline to form colors. Accordingly, the organic bases used in the present invention scarcely contaminate recording materials during storage, can be freely varied in color-forming temperature if organic bases different in melting point are selected, and are sufficiently high in reaction rate, so that they are usable not only for copying but also for recording using for output printers of desk-top electronic calculators and information-processing computers, hot-pen recorders, etc. and do not require any such complicated synthesis as in the case of aminebisphenol complexes.

A large number of substances capable of forming colors by treatment with alkalis have been known. Examples of these substances are diazo compounds and couplers, sulfophthalein and phenolphthalein type pH indicators, ninhydrin derivatives and fluorescein derivatives. These substances, however, are unstable to light or they themselves are colored and hence undesirably color the resulting heat-sensitive recording sheets; or are so water-soluble that they immediately react with organic bases to develop colors, and hence are not usable for preparation of heat-sensitive recording sheets. Although the phenolphthalein type pH indicators less color the heat-sensitive sheets, they require a high basicity for color formation, and hence are not satisfactory in practice and cannot successfully be used for preparation of heat-sensitive recording sheets. Among the substances exemplified above, the fluorescein type derivatives are relatively excellent. However, most of them have been colored, and even those which have not been colored are so susceptible to pH as to develop colors unless they are dispersed at an acidic pH below 4, and are extremely low in storability.

On the other hand, the acylated lactone or sultone type acidic leuco dyes used in the present invention are scarcely water-soluble, are stable to light, and are extremely high in storage stability since they do not develop colors unless the atmosphere is made alkaline. Moreover, they themselves are pale-colored or colorless, so that textures of the resulting heat sensitive recording sheets can be maintained white without being colored.

Organic bases usable in the present invention include various compounds. However, if the organic bases are excessively low in melting point or extremely high in water solubility, the heat-sensitive layers formed by use of said organic bases tend to discolor during storage. Accordingly, the organic bases to be used in the present invention should be those which are solid at normal temperature and, preferably, those which have a melting point of above 60° C. Further, if the organic bases are excessively low in basicity, the heat-sensitive layers tend to develop colors with difficulty to bring about practical disadvantages.

Among the organic bases used in the present invention, those which are particularly excellent in practice are guanidine derivatives represented by the general formula,

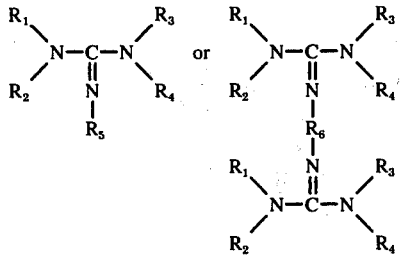

wherein $R_1$, $R_2$, $R_3$, $R_4$ and $R_5$ represent individually hydrogen atom or alkyl having 18 or less carbon atoms, cyclic alkyl, aryl, aralkyl, amino, alkylamino, acylamino, carbamoylamino, amidino, cyano or heterocyclic residue: $R_6$ represents lower alkylene, phenylene, naphthylene or

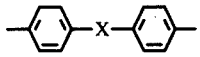

wherein X is lower alkylene, $SO_2$, $S_2$, S, O, —NH— or single bond); and the aryl group includes those having a substituent selected from the group consisting of lower alkyl, alkoxy, nitro, acylamino and alkylamino groups and halogens. Typical examples of the organic bases are as shown in Table 1A, though these are not limitative. In the table,

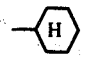
represents a cyclohexyl group.
Table 1A
(1)
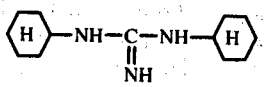
(2)
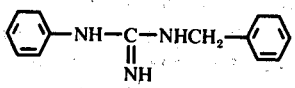
(3)
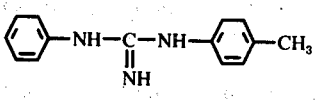
(4)
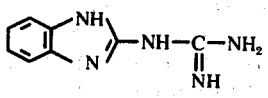
(5)
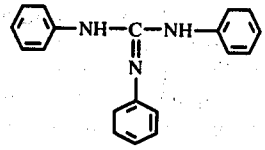
(6)
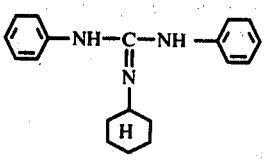
(7)
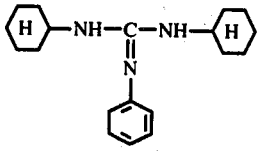
(8)
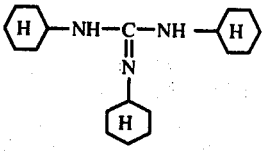
(9)
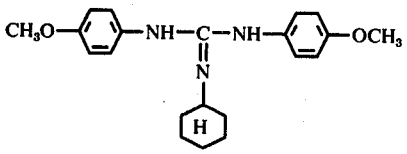
(10)
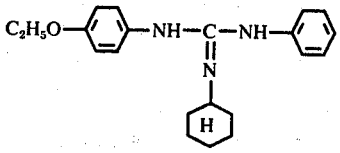
Table 1A-continued
(11)
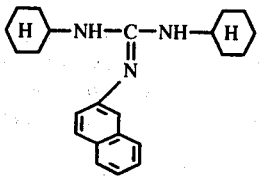
(12)
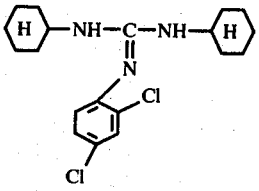
(13)
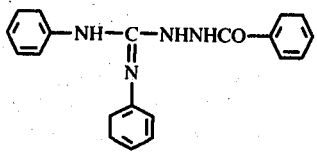
(14)
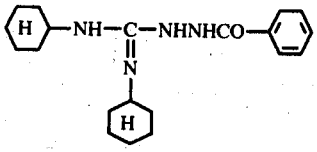
(15)
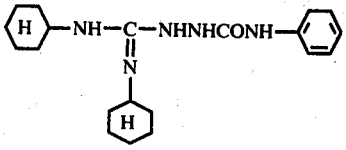
(16)
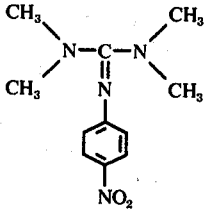
(17)
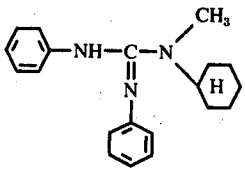
(18)
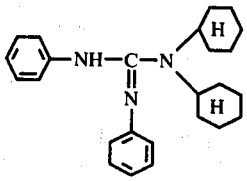
(19)
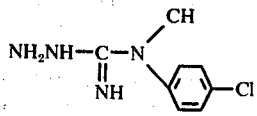
(20)
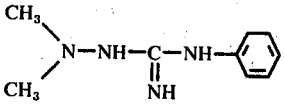

Table 1A-continued
(21)
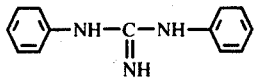
(22)
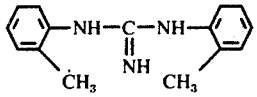
(23)
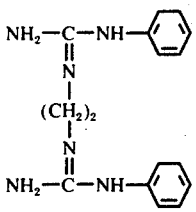
(24)
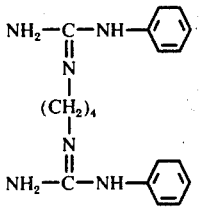
(25)
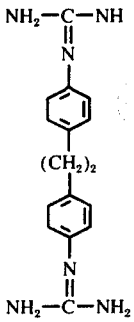
(26)
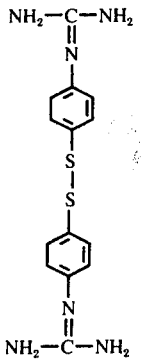
(27)
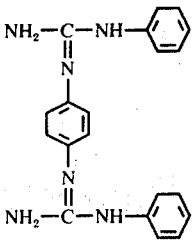
Table 1A-continued
(28)
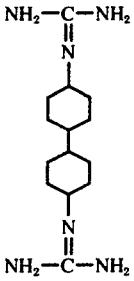
(29)
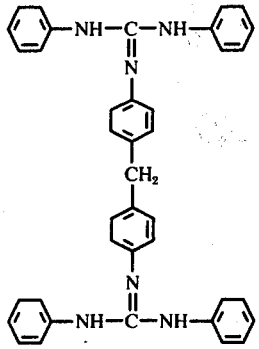
(30)
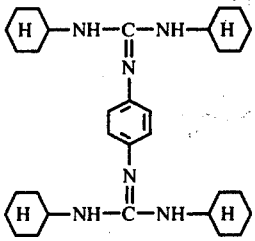
(31)
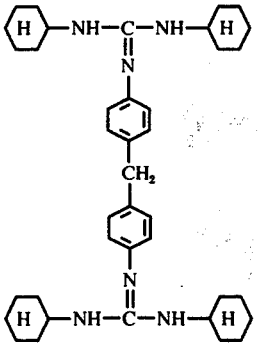
(32)
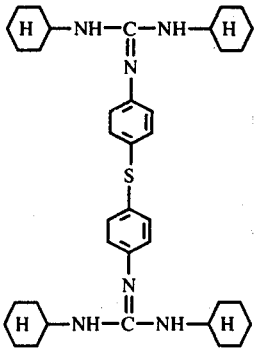

Table 1A-continued
(33)
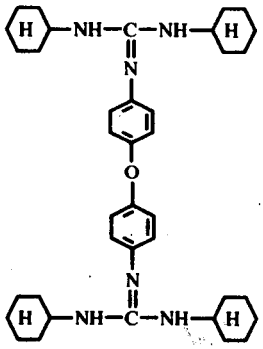
(34)
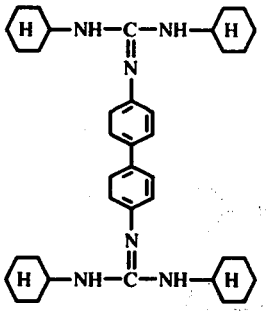
(35)
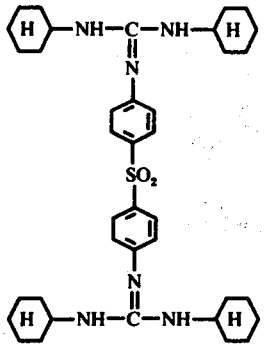
(36)
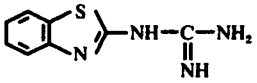
(37)
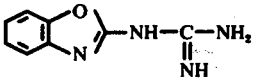
(38)
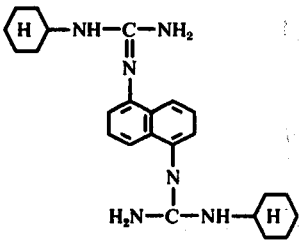
Table 1A-continued
(39)
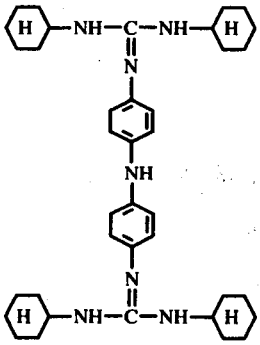
(40)
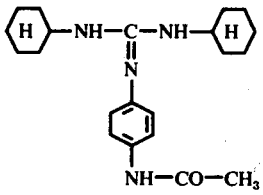
(41)
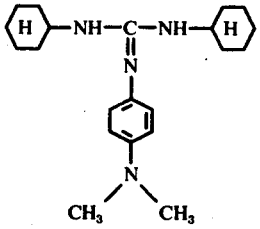
(42)
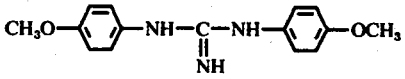
(43)
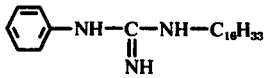
(44)
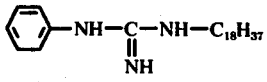
(45)
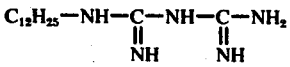
(46)
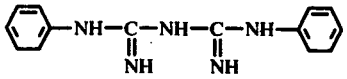
(47)
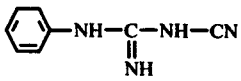
(48)
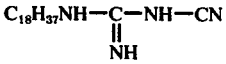
(49)
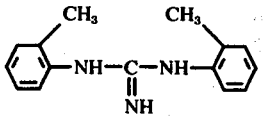
As organic bases usable in the present invention, there may be shown, in addition to the abovementioned organic bases, such compounds as represented by the general formula,

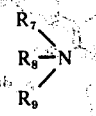

wherein $R_7$, $R_8$ and $R_9$ represent individually hydrogen atom or alkyl having up to 18 carbon atoms, aminosubstituted alkyl, cycloalkyl, aralkyl or heterocyclic residue, including the case where at least two of $R_7$, $R_8$ and $R_9$ bond each other at a position other than N in the formula to form a ring together with N. Typical examples of the said compounds are as shown in Table 1B, though these are not limitative.

Table - 1B

50. Tribenzylamine
51. N,N,N',N'-Tetrabenzyl-ethylenediamine
52. N,N,N',N'-Tetrabenzyl-hexamethylenediamine
53. Decamethylenediamine
54. Tricyclohexylamine
55. N,N'-Dibenzylpiperazine
56. Dioctadecylamine
57. 2-Aminobenzoxazole
58. 2-Aminobenzothiazole
59. 2-Aminobenzimidazole
60. Quinine
61. Cyclohexyl-dibenzylamine
62. Octadecyl-dibenzylamine The organic bases shown in Tables 1A and 1B can be synthesized according to known processes or to processes similar thereto.

The acylated lactone or sultone type acidic leuco dyes used in the present invention are dyes which are colorless or pale-colored at an acidic or neutral pH but exhibit deep colors at an alkaline pH, and are preferably those which are sparingly soluble in water. In practice, acylated xanthene lactone type acidic leuco dyes are particularly preferred in view of the stability or the resulting heat-sensitive coating solutions and heat-sensitive sheets, and in view of the light fastness, coloration speed and coloration density of the heat-sensitive sheets.

The acylated lactone or sultone type acidic leuco dyes used in the present invention may be represented, though not limitative, by the general formula, (a)

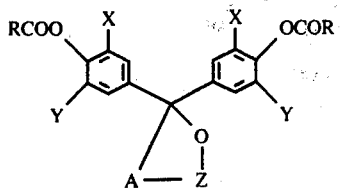

(b)

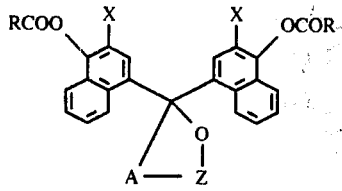

-continued (c)

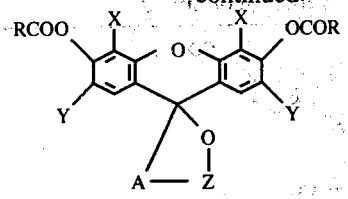

(d)

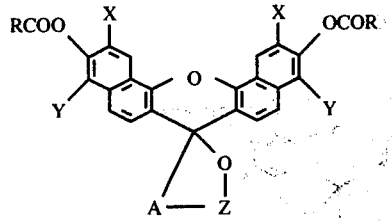

or (e)

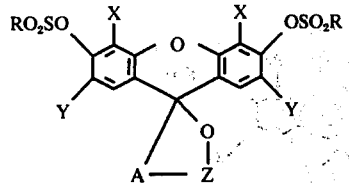

wherein R represents a group selected from R' and R'—$SO_2$— groups, wherein R' represents a group selected from phenyl, substituted phenyl, lower alkyl, lower alkoxy and lower halogenated alkyl groups; X and Y, which may be same or different, represent individually a member selected from hydrogen and halogen atoms, and lower alkyl and nitro groups; Z represents a group selected from

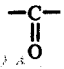

and —$SO_2$—; and A represents a saturated or unsaturated carbon atom group necessary to form a 5- or 6-membered ring together with Z, O and the carbon atom on the xanthene ring which has been linked to O, including the case where the said atom group has been condensed with any of benzene, halogensubstituted benzene, naphthalene and cyclohexane rings.

Typical examples of the above-mentioned dyes are as shown in Table - 2, though these are not limitative.

Table 2

(1)

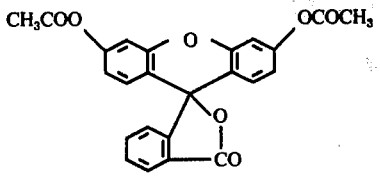

(2)

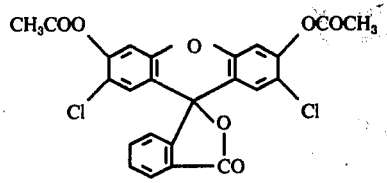

(3)

Table 2-continued
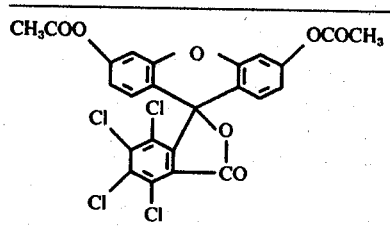
(4)
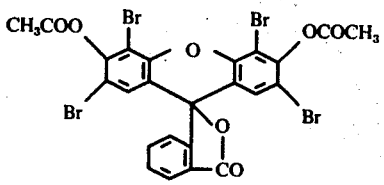
(5)
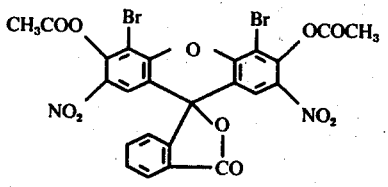
(6)
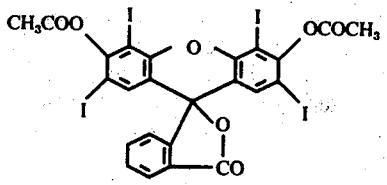
(7)
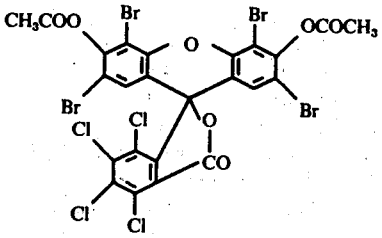
(8)
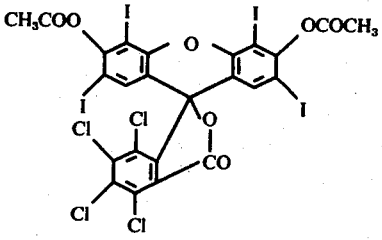
(9)
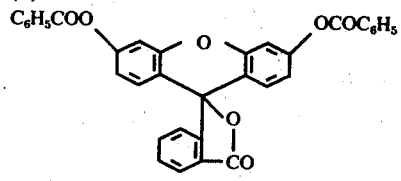
(10)
Table 2-continued
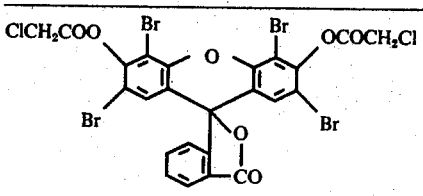
(11)
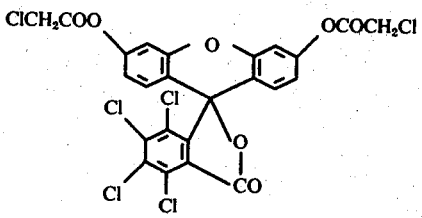
(12)
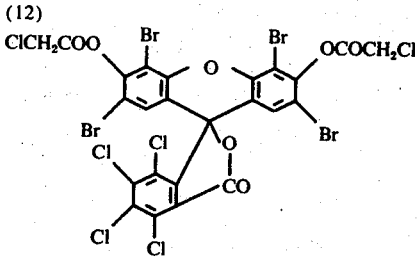
(13)
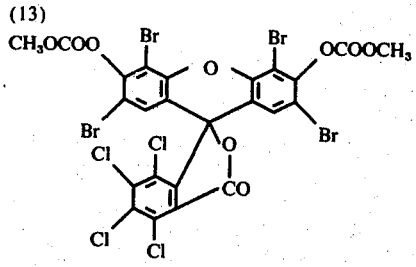
(14)
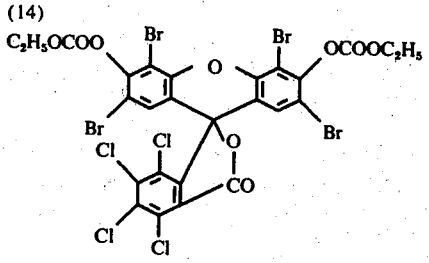
(15)
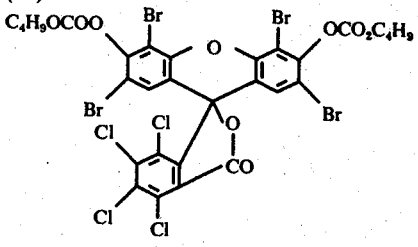
(16)
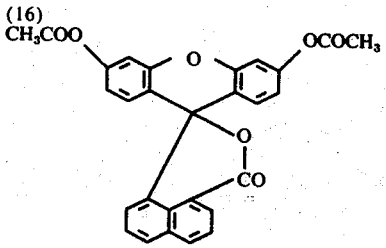

Table 2-continued
(17)
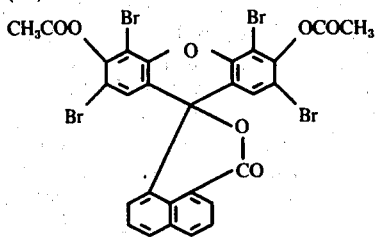
(18)
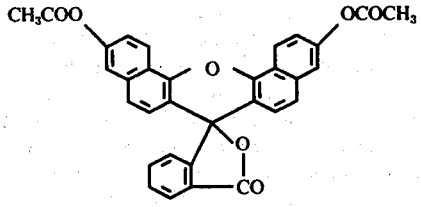
(19)
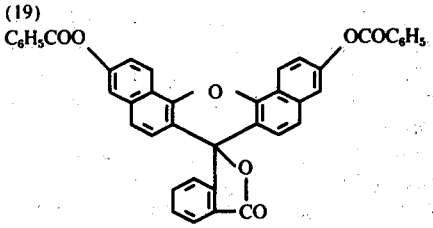
(20)
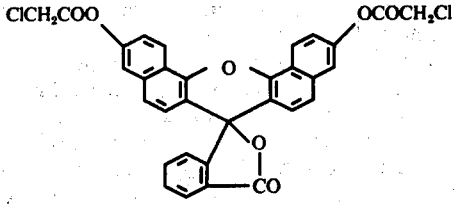
(21)
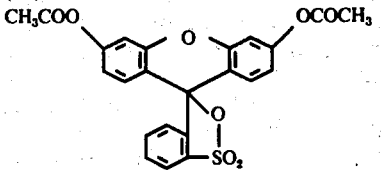
(22)
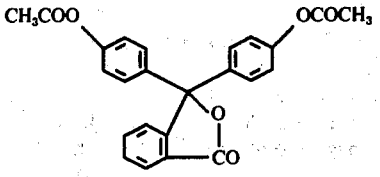
(23)
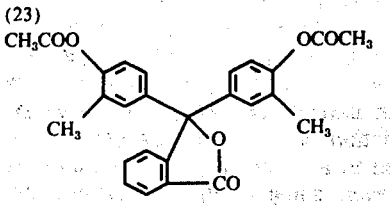
(24)
Table 2-continued
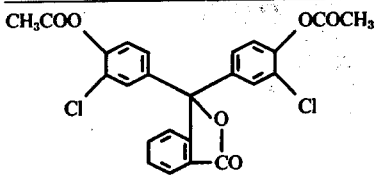
(25)
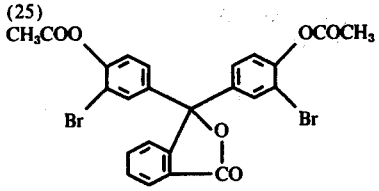
(26)
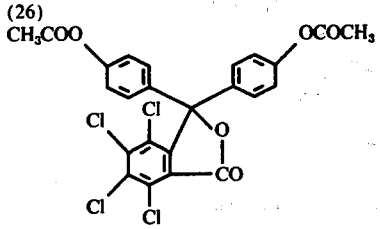
(27)
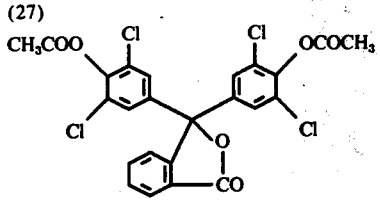
(28)
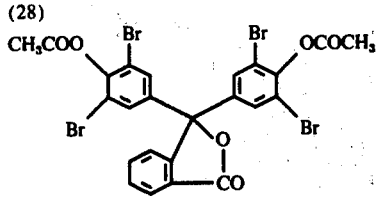
(29)
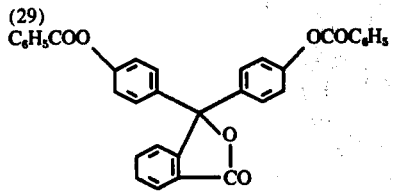
(30)
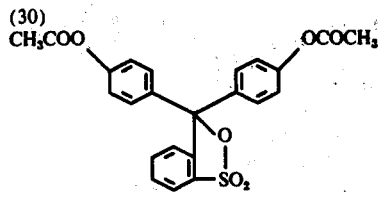
(31)
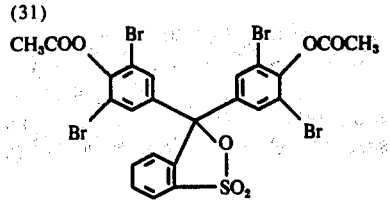
(32)

Table 2-continued

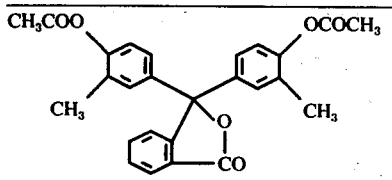

(33)

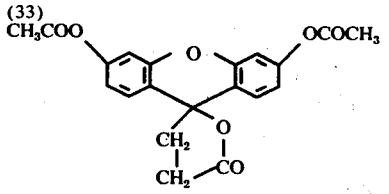

(34)

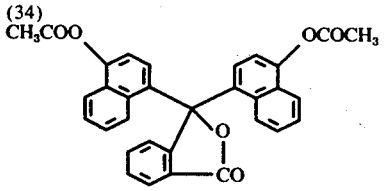

(35)

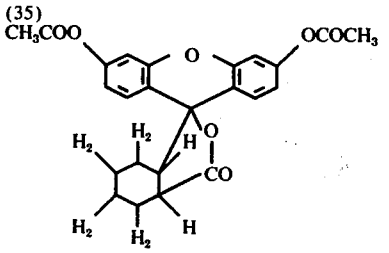

(36)

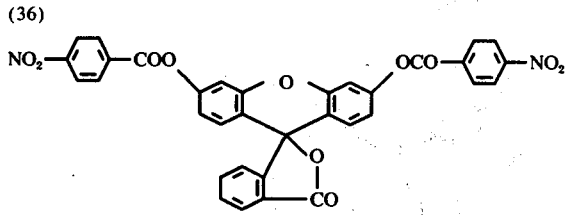

(37)

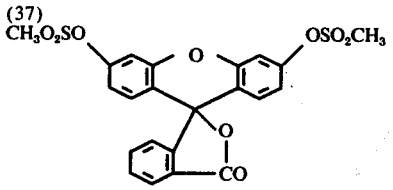

(38)

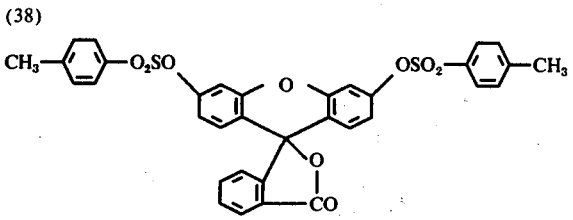

In order to obtain a desired color tone, the above-mentioned dyes may of course be used in the form of a mixture of two or more members, or may be used in combination with unacylated lactone or sultone type acidic leuco such as fluorescein derivative or phenolphthalein derivatives.

The acylated lactone or sultone type acidic leuco dyes shown in Table 2 can be synthesized according to known processes or to processes similar thereto.

In the present invention, The above-mentioned two components, i.e. the organic base and the acylated lactone or sultone type acidic leuco dye, are dispersed in an aqueous medium, and the resulting dispersion is coated on a support such as paper or film. In this case, a binder is required to be used which is preferably a water-soluble resin. Concrete examples of said water-soluble resin are polyvinyl alcohols, methyl cellulose, hydroxyethyl cellulose, gum arabic, carboxymethyl cellulose, starch, gelatin, casein, polyvinyl pyrrolidone, styrene-maleic anhydride copolymers, methyl vinyl ether-maleic anhydride copolymers, polyacrylates, polyacrylic acid copolymers, and latexes such as styrene-butadiene latexes. At the time of dispersion, the organic base and the acylated lactone or sultone type acidic leuco dye are preferably pulverized as fine as possible by means of a pulverizer such as a ball mill until the particles become several microns in particle size. The above-mentioned two components may be dispersed in a petroleum medium in place of the aqueous medium. In this case, a petroleum-soluble resin such as cyclized rubber is used as the binder. In both cases, stabilizers, surfactants, fillers and the like may further be added for the improvement in coatability, the enhancement in whiteness, the prevention of coloration due to pressure, etc.

The mixing ratio of the organic base to the acylated leuco dye is preferably 1 : 1 – 50.

As one embodiment of the present invention, a multicolor heat-sensitive recording sheet, which has been prepared by adding a known chromogenic system to the above-mentioned monochromatic heat-sensitive recording sheet, is explained below.

The present inventors have already found that a heat-sensitive system, which has been prepared by finely dispersing to the form of a layer or layers a phenolic substance and a colorless or pale-colored basic chromogenic substance (e.g. Crystal Violet Lactone) capable of forming a color by reaction with said phenolic substance and incorporation into the resulting layer, or a layer adjacent thereto, a dispersion of an organic base capable of melting at a temperature higher than that required for melting of the phenolic substance, can form a color on heating but the colored system is faded in color or decolored on heating at a temperature higher than that at which the organic base is melted. The inventors have further found that when the above-mentioned heat-sensitive system is incorporated with another acidic chromogenic substance capable of forming another color by reaction with said organic base, formation of monocolors different in hue takes place simultaneously with the abovementioned decoloration to give a clear dichromatic image (refer to Japanese Patent Application No. 7004/1973). As described in said Japanese patent application, examples of the acidic chromogenic substance capable of forming a color by reaction with the organic base at an elevated temperature which is used in the above case are pH indicators, fluorescein derivatives and phenolphthalein derivatives which cause coloration or discoloration at an alkaline pH; which causes discoloration due to oxidation or reduction in a broad sense when pH is varied to an alkaline side; and ninhydrin substances. However, some of the abovementioned substances are water-soluble, so that they form colors immediately even when no heat is applied thereto to give heat-sensitive sheets which have been greatly colored in texture, while the others cause vigorous coloration of coating liquids at the time of preparation thereof to bring about such disadvantages that the resulting heat-sensitive sheets are markedly colored in texture unless the pH is lowered to 4 to 5, with the result that the heat-sensitive sheets are greatly deteriorated in storability. Thus, the abovementioned are not satisfactory for use in multicolor heat-sensitive recording sheets.

With an aim to improve the stability of acidic chromogenic substances which form colors by reaction with organic bases at elevated temperatures, the present inventors repeated extensive studies to find that the aforesaid acylated lactone or sultone type acidic leuco dyes are scarcely water-soluble, substantially colorless and extremely stable at a neutral pH, and that multicolor heat-sensitive recording sheets obtained by use of said dyes are quite stable.

The multicolor heat-sensitive recording sheet of the present invention comprises a chromogenic system consisting of a known phenolic substance and a basic chromogenic substance capable of forming a color by reaction with said phenolic substance at an elevated temperature, and a chromogenic system consisting of the aforesaid organic base and the aforesaid acylated lactone or sultone type acidic leuco dye capable of forming a color by reaction with said organic base at an elevated temperature. That is, the recording sheet of the present invention is composed essentially of the said four components. In case these four components are desired to be incorporated into one coating layer, it is necessary for formation of brilliant two colors that the organic base is higher in melting point or lower melting speed than the phenolic substance.

That is, when heat is applied to the heat-sensitive layer, (1) the phenolic substance first melts, and such basic chromogenic substance as leuco lactone compound, which can form a color by reaction with the said phenolic substance, first develops a color, (2) when a certain temperature is reached by further application of heat, the organic base melts, and the basicity thereof overcomes the effect of said phenolic substance to make the atmosphere basic, whereby the lactone ring of the basic substance, which has developed a color by reaction with the phenolic substance, is closed to cause decoloration, and (3) the acyl group of the acidic chromogenic substance, which can develop a color by reaction with said organic base, is released, whereby the lactone or sultone ring thereof is cut to form a color.

In the above case, it is extremely important for formation of brilliant two colors that when heated at a higher temperature, the basic chromogenic substance, which has developed a color at a low temperature, has such property as to be decolored according to the change of atmosphere from the phenolic atmosphere to the organobasic atmosphere. Even if the basic chromogenic substance capable of forming a color at a low temperature has no such decoloration property as mentioned above, it is tentatively possible to obtain two colors; a low temperature color (monocolor) and a high temperature color (mixed color). In such case, however, the colors are inferior in brilliancy, and it is difficult to obtain a practically excellent recording sheet.

In case the organic base and the phenolic substance are formed into separate layers by multilayer coating, e.g. in case a layer containing the organic base and an acidic chromogenic substance capable of forming a color by reaction with said organic base is first formed and then a layer containing the phenolic substance and a basic chromogenic substance capable of forming a color by reaction with said phenolic substance is formed on the above-mentioned layer, two colors can be formed even when the organic base does not substantially differ in melting point from, or is lower in melting point than, the phenolic substance, since there is a difference in thermal conductivity between the two layers. For example, in case the upper and lower layers are same in color formation temperature, and lower layer does not form a color if heat necessary for color formation of the upper layer is applied thereto, because the lower layer differs in thermal conductivity from the upper layer or the heat is consumed by the upper layer. For color formation of the lower layer, therefore, it is necessary to apply further heat. In practice, therefore, the two layers are different in color formation temperature. Even if the organic base is lower in melting point, the upper layer can form a color when a thermofusible substance lower in melting point than the organic base is incorporated into the upper layer at a temperature corresponding to the melting point of the thermofusible substance.

The proportions of the organic base and phenolic substance to be used vary depending on the degrees of basicity and acidity of the organic base and phenolic substance used, and on whether they are formed into a single layer or a plurality of layers. Preferably, however, the amount of the organic base is 10 to 900% based on the amount of the phenolic substance. The mixing ratio of the phenolic substance to the basic chromogenic substance is preferably 1 : 1 - 1 : 20.

The phenolic substance used in the present invention is a phenolic compound having a melting point of above normal temperature, preferably above 60° C. Typical examples thereof are as shown in Table - 3, though these are not limitative.

Table - 3

1. 4,4'-Isopropylidenediphenol
2. 4,4'-Isopropylidenebis(2-chlorophenol)
3. 4,4'-Isopropylidenebis(2-tert-butylphenol)
4. 4,4'-sec-Butylidenediphenol
5. 4,4'-(1-Methyl-n-hexylidene)diphenol
6. 4-Phenylphenol
7. 4-Hydroxydiphenoxide
8. Methyl-4-hydroxybenzoate
9. Phenyl-4-hydroxybenzoate
10. 4-Hydroxyacetophenone
11. Salicylanilide
12. 4,4'-Cyclohexylidenediphenol
13. 4,4'-Cyclohexylidenebis(2-methylphenol)
14. 4,4'-Benzylidenediphenol
15. 4,4'-Thiobis(6-tert-butyl-3-methylphenol)
16. Novolak type phenol resins
17. Halogenated novolak type phenol resins
18. $\alpha$-Naphthol
19. $\beta$-Naphthol Among the above-mentioned phenolic compounds, those having at least two hydroxyl groups in one molecule are particularly preferred.

The basic chromogenic substance capable of forming a color by reaction with the phenolic compound which is used in the present invention is a colorless or somewhat palecolored lactone, sultone, lactam or spiropyran compound, etc. Typical examples thereof are as shown in Table - 4, though these are not limitative.

Table - 4

1. Crystal Violet Lactone
2. Malachite Green Lactone
3. 3,3-Bis-(p-dimethylaminophenyl)-6-aminophthalide
4. 3,3-Bis(p-dimethylaminophenyl)-6-(p-toluenesulfonamide)phthalide
5. 3-Diethylamino-7-(N-methylanilino)fluoran
6. 3-Diethylamino-7-(N-methyl-p-toluidino) fluoran
7. 3-Dimethylamino-6-methoxyfluoran
8. 3-Diethylamino-7-chlorofluoran
9. 3-Diethylamino-6-methyl-7-chlorofluoran
10. 3-diethylamino-7-phenylfluoran
11. 3-Morpholino-5,6-benzofluoran
12. 3-Diethylamino-5-methyl-7-dibenzylaminofluoran
13. 3-Diethylamino-7-dibenzylaminofluoran
14. 3-Diethylamino-7,8-benzofluoran
15. 3-Cyclohexylamino-6-chlorofluoran
16. N-Phenylrhodamine B Lactam
17. Acid Rhodamine B Sultone
18. Benzo-β-naphthospiropyran
19. 1,3,3-Trimethyl-6′-chloro-8′-methoxyindolinobenzospiropyran The multicolor heat-sensitive recording sheet of the present invention can be obtained according to the following process:

That is, the four members of a phenolic substance, a basic chromogenic substance capable of forming a color by reaction with said phenolic substance, an organic base, and an acylated lactone or sultone type acidic leuco dye capable of forming a color by reaction with said organic base are individually pulverized and dispersed to less than several microns by use of a pulverizer such as a ball mill in a medium containing a binder at an appropriate concentration. The thus obtained four dispersions are mixed together into one liquid, which is then incorporated, if necessary, with proper amounts of a whiteness-increasing agent, a wetting agent, a stabilizer and other various fillers to prepare a heat-sensitive coating liquid. This coating liquid is coated on an appropriate support and then dried to obtain a heat-sensitive recording sheet.

As the binder, there may be used the same compound as in the case of the monochromatic heat-sensitive recording sheet mentioned above. As the support, paper is ordinarily used, but any one of synthetic resin films, laminate papers and woven fabric sheets may also be used.

Substantially the same process as above is adopted also in the case where a plurality of layers are desired to be formed.

Further, in case the acidic chromogenic substance capable of forming a color by reaction with the organic base, for example, is soluble in a dispersion solvent, there is adopted such a process that the said acidic chromogenic substance is dissolved in the dispersion solvent, the resulting solution is coated on a support by impregnation or the like procedure to form a layer, and then a dispersion of the other components is coated on the thus formed layer.

The present invention is illustrated in more detail below with reference to examples.

EXAMPLE 1

| | |
|---|---|
| Liquid A: | |
| Compound (1) in Table-2 | 10 g. |
| 5% Aqueous polyvinyl alcohol solution | 10 g. |
| Water | 20 g. |
| Liquid B: | |
| Compound (7) in Table-1 | 50 g. |
| 5% Aqueous polyvinyl alcohol solution | 50 g. |
| Water | 100 g. |

The above-mentioned two liquids A and B were individually ball-milled for 1 day, and then mixed with each other. To the resulting mixture was added 120 g. of a 10% aqueous polyvinyl alcohol solution, thereby preparing a heat-sensitive coating liquid. This coating liquid was coated on a usual paper having a basis weight of 50 g/m² in such an amount that the weight of the coating after drying became 3 g/m², and was then dried to obtain a heat-sensitive recording sheet. The thus obtained heat-sensitive recording sheet was substantially white in texture, and instantaneously formed an orange color when recorded with a hot pen.

Heat-sensitive recording sheets were prepared in the same manner as above, except that the compound (1) in Table 2 was replaced by each of the compounds shown in Table 5 and the compound (7) in Table 1 was replaced by each of the compounds shown in Table 5. These recording sheets formed such colors as set forth in Table 5.

Table 5

| Run No. | Compound in Table 2 | Compound in Table 1 | Formed color | Color formation temperature |
|---|---|---|---|---|
| 1 | (4) | (7) | Red | 160° C. |
| 2 | (11) | (7) | Red | " |
| 3 | (12) | (7) | Red | " |
| 4 | (19) | (7) | Green | " |
| 5 | (16) | (7) | Orange | " |
| 6 | (23) | (7) | Red | " |
| 7 | (30) | (7) | Red | " |
| 8 | (33) | (7) | Red | " |
| 9 | (3) | (22) | Orange | 180° C. |
| 10 | (5) | (31) | Red | 190° C. |
| 11 | (1) | (55) | Orange | 130° C. |

EXAMPLE 2

| | |
|---|---|
| Liquid A: | |
| Compound (12) in Table 2 | 10 g |
| 5% Aqueous hydroxyethyl cellulose solution | 10 g. |
| Water | 20 g. |
| Liquid B: | |
| Compound (39) in Table 1 | 50 g. |
| 5% Aqueous hydroxyethyl cellulose solution | 50 g. |
| Water | 100 g. |

The above-mentioned two liquids A and B were individually ball-milled for 1 day, and then mixed with each other. To the resulting mixture were added 100 g. of a 20% wax emulsion (trade name "Repol No. 50" produced by Daikyo Chemical K.K.), 100 g. of wheat starch, 300 g. of a 5% aqueous hydroxyethyl cellulose solution, 80 g. of a 20% aqueous styrene-maleic anhydride copolymer solution (trade name "Malon NS" produced by Daido Kogyo K.K.) and 20 g. of a 10% surfactant (trade name "Dowfax 2A-1" produced by Dow Chemical Co.). thereby preparing a heat-sensitive coating liquid. This coating liquid was coated on a usual paper having a basis weight of 50 g/m² in such an amount that the weight of the coating after drying became 8 g/m², and was then dried to obtain a heat-sensitive recording sheet.

Separately, heat-sensitive recording sheets were prepared in the same manner as above, except that the compound (12) in Table 2, which was used in the liquid A, was replaced by each of the compounds shown in Table 6.

The thus prepared heat-sensitive recording sheets had such properties as set forth in Table 6. The recording sheet prepared by use of the compound of the present invention was substantially white in texture, formed a brilliant red color when recorded with a hot pen, and was markedly excellent in storability.

Table 6

| Compound in Table 2 | Coloration of texture | Density of formed color | Storability | Remarks |
|---|---|---|---|---|
| (12) | | | | Present invention |
| 3,4,5,6-Tetrachloro- | ○ | ○ | ○ | Out of the |
| 2',4',5',7'-tetrabromo- | X | ○ | X | scope of the |
| fluorescein | | | | present invention |
| Phenolphthalein | ○ | X | ○ | " |
| Phenol Red | X | Δ | X | " |

Notes:
Coloration of texture (coloration of texture after drying):
○ — Less in coloration of texture
X — Marked in coloration of texture Density of formed color (density of color formed on heating at 180° C. for 1 second):
○ — High
X — Low
Δ — Somewhat low
Storability (at 40° C. for 1 week):
○ — No coloration of texture
X — Marked coloration of texture

EXAMPLE 3

The liquid B used in Example 2 was coated on a usual paper having a basis weight of 50 g/m² in such an amount that the weight of the coating after drying became 3 g/m², and was then dried to form a layer. Subsequently, the liquid A used in Example 2 was coated on said layer so that the weight of the coating after drying became 1 g/m², and was then dried to prepare a heat-sensitive recording sheet. The thus prepared recording sheet was substantially white in texture, and formed a brilliant red color when recorded with a hot pen. A heat-sensitive recording sheet was prepared by replacing the liquid B by a 5% aqueous sodium carbonate solution, impregnating a usual paper with the 5% aqueous sodium carbonate solution and coating the liquid A thereon and drying it as mentioned above. This recording sheet was not only marked in coloration of texture but also formed no color unless it was heated to above 200° C.

EXAMPLE 4

| | |
|---|---|
| Liquid A: | |
| Compound (1) in Table 4 | 1 g. |
| 5% Aqueous hydroxyethyl cellulose solution | 1 g. |
| Water | 2 g. |
| Liquid B: | |
| Compound (5) in Table 3 | 8 g. |
| 5% Aqueous hydroxyethyl cellulose solution | 8 g. |
| Water | 16 g. |
| Liquid C: | |
| Compound (7) in Table 1A | 6 g. |
| 5% Aqueous hydroxyethyl cellulose solution | 6 g. |
| Water | 12 g. |
| Liquid D: | |
| Compound (1) in Table 2 | 1 g. |
| 5% Aqueous hydroxyethyl cellulose solution | 1 g. |
| Water | 2 g. |

The above-mentioned four liquids A, B, C and D were individually ball-milled for 1 day, and then mixed with one another. To the resulting mixture were added 10 g. of 50% wheat starch dispersion, 35 g. of a 10% aqueous hydroxyethyl cellulose solution, 35 g. of a 10% aqueous styrene-meleic anhydride copolymer solution (trade name "Malon MS") and 10 g. of a 20% wax emulsion, and the mixed liquid was adjusted to a suitable viscosity by addition of water to prepare a heat-sensitive coating liquid. This liquid was coated on a usual paper having a basis weight of 50 g/m² in such an amount that the weight of the coating after drying became 10 g/m², and was then dried at below 40° C. to obtain a heat-sensitive recording sheet. The thus obtained recording paper was a dichromatic heat-sensitive recording sheet white in texture which formed a blue color at 90° to 120° C. and an orange color at above 130° C. which orange color had scarcely been mixed with the blue color. This recording sheet was so stable that it scarcely changed in texture and in colored portions even when allowed to stand at 40° C. for 1 week.

EXAMPLE 5

Dichromatic heat-sensitive recording sheets were prepared in the same manner as in Example 4, except that the compound (1) in Table 4 which was used in the liquid A, the compound (7) in Table 1A which was used in the liquid C, and the compound (1) in Table 2 which was used in the liquid D in example 4, were individually replaced by such compounds as shown in Table 7. Colors formed by each recording sheet were as set forth in Table 7.

Table 7

| Run No. | Liquid A Compound in Table 4 | Liquid B Compound in Table 3 | Liquid C Compound in Table 1 | Liquid D Compound in Table 2 | Color formed at low temperature | Color formed at high temperature |
|---|---|---|---|---|---|---|
| 1 | (1) | (5) | (7) | (3) | Blue at 90°–120° C. | Red at above 130° C. |
| 2 | (1) | (5) | (7) | (12) | Blue " | Red " |
| 3 | (1) | (5) | (7) | (18) | Blue " | Green " |
| 4 | (1) | (5) | (7) | (22) | Blue " | Red " |
| 5 | (1) | (5) | (7) | (30) | Blue " | Red " |
| 6 | (1) | (5) | (31) | (5) | Blue " | Red " |
| 7 | (1) | (5) | (31) | (6) | Blue " | Red " |
| 8 | (1) | (5) | (55) | (9) | Blue " | Orange " |
| 9 | (9) | (5) | (31) | (19) | Red at 90°–130° C. | Green at above 140° C. |
| 10 | (9) | (5) | (31) | (31) | Red " | Purple " |

EXAMPLE 6

Liquid C used in Example 4 in which the compound (7) in Table 1A was replaced by the compound (22) in Table 1A was mixed with 8 g. of a 10% aqueous Malon MS solution. The resulting liquid was coated on a usual paper having a basis weight of 50 g/m² in such an amount that the weight of the coating after drying became 3 g/m², and was then dried to form a layer.

On the other hand, the same liquids A, B and D as in Example 4, except that the compound (5) in Table 3 which was used in the liquid B was replaced by the compound (1) in Table 3, were mixed with one another. To the resulting mixture were added 10 g. of a 50% wheat starch dispersion, 25 g. of a 10% aqueous hydroxyethyl cellulose solution, 25 g. of a 10% aqueous Malon MS solution, 10 g. of a 20% wax emulsion and 10 cc. of a 10% surfactant, and the mixed liquid was adjusted to a suitable viscosity by addition of water to prepare a coating liquid.

This liquid was coated on the aforesaid layer in such an amount that the weight of the coating after drying became 5 g/m², and was then dried to obtain a heat-sensitive recording sheet. The thus obtained recording sheet was substantially white in texture and formed a blue color at 150° to 170° C. and an orange color at above 180° C., and the texture was scarcely colored even when the recording sheet was allowed to stand at 40° C. for 1 week.

For comparison, a heat-sensitive recording sheet was prepared in the same manner as above, except that the compound (1) in Table 2 which was used in the liquid D was replaced by 2', 4', 5', 7'-tetrabromofluorenscein. This recording sheet formed a blue color at 150° to 170° C. and a red color at above 180° C. but became red in texture, and the texture was markedly contaminated when the recording sheet was allowed to stand at 40° C. for 1 week.

EXAMPLE 7

1 Gram of the compound (31) in Table 2A and 3 g. of a 10% aqueous casein solution were ball-milled for 1 day to prepare a coating liquid. This liquid was coated on a usual paper having a basis weight of 50 g/m² in such an amount that the weight of the coating after drying became 3 g/m² and was then dried to form a layer.

On the other hand, a coating emulsion was prepared in the same manner as in Example 4 by mixing the liquids A, B and C of the below-mentioned compositions with 10 g. of 50% wheat starch dispersion and 54 g. of a 10% aqueous polyvinyl alcohol solution. This emulsion was coated on the aforesaid layer in the same manner as in Example 4, and was then dried to obtain a heat-sensitive recording sheet.

| | |
|---|---|
| Liquid A: | |
| Compound (1) in Table 4 | 1 g. |
| 5% Aqueous polyvinyl alcohol solution | 1 g. |
| Water | 2 g. |
| Liquid B | |
| Compound (1) in Table 3 | 8 g. |
| Palmitamide (trade name Fatty Acid Amide P produced by Nitto Chemical K.K.) | 3 g. |
| 5% Aqueous polyvinyl alcohol solution | 11 g. |
| Water | 22 g. |
| Liquid C: | |
| Compound (1) in Table 2 | 0.7 g. |
| Compound (12) in Table 2 | 0.3 g. |
| 5% Aqueous polyvinyl alcohol solution | 1 g. |
| Water | 2 g. |

The thus obtained heat-sensitive recording sheet was an excellent dichromatic heat-sensitive sheet which formed a blue color at 100° to 140° C. and a red color at above 150° C.

EXAMPLE 8

| | |
|---|---|
| Liquid A: | |
| Compound (6) in Table 4 | 1 g. |
| 5% aqueous polyvinyl alcohol solution | 4 g. |
| Water | 4 g. |
| Liquid B: | |
| Compound (13) in Table 3 | 8 g. |
| 5% aqueous polyvinyl alcohol solution | 32 g. |
| Water | 32 g. |

The above-mentioned two liquids A and B were individually ball-milled for 24 hours, and then mixed with each other to prepare a coating liquid. This liquid was coated on a usual paper having a basis weight of 50 g/m² in such an amount that the weight of the coating after drying became 5 g/m² and was then dried to form a layer. Subsequently, the same coating liquid as in Example 4 was coated on the thus formed layer and then dried to prepare a heat-sensitive sheet, which was then subjected to calendering to make the coated surface smooth. The thus obtained sensitive-sheet formed blue color at 90° to 120° C., a brilliant orange color at 130° to 160° C., and a black color at above 160° C.

EXAMPLE 9

| | |
|---|---|
| Liquid A: | |
| Compound (18) in Table 2 | 1 g. |
| 5% Aqueous hydroxyethyl cellulose solution | 1 g. |
| Water | 2 g. |
| Liquid B: | |
| Compound (7) in Table 1 | 3 g. |
| 5% Aqueous hydroxyethyl cellulose solution | 3 g. |
| Water | 6 g. |

The above-mentioned two liquids A and B were individually ball-milled for 24 hours, and then mixed with each other. To the resulting mixture, 15 g. of 10% Cellogen 5A (trade name of carboxymethyl cellulose produced by Dai-ichi Kogyo Seiyaku K.K.) to prepare a coating liquid. This liquid was coated on a usual paper having a basis weight of 50 g/m² in such an amount that the weight of the coating after drying became 4 g/m² and then dried to form a layer. Subsequently, a 2% aqueous Malon MS solution was coated on the thus formed layer in such an amount that the weight of the coating after drying became 0.5 g/m² and then dried to form another layer thereon. This layer was further coated with the coating liquid used in Example 4, and the resulting composite was dried to obtain a heat-sensitive sheet, which was then subjected to calendering to make the coated surface smooth. The thus obtained heat-sensitive sheet formed a blue color at 90° to 120° C., a brilliant orange color at 130° to 160° C. and a greenish black color, which was a mixed color consisting of orange and green colors, at above 160° C., and thus developed three brilliant colors at low, medium and high temperatures.

What is claimed is:

1. A heat sensitive recording sheet which comprises a support and a heat sensitive composition coated thereon which comprises a solid amine derivative and at least one acylated lactone or sultone type acidic leuco dye capable of reacting with said amine derivative at an elevated temperature to form a color.

2. A heat sensitive recording sheet according to claim 1, wherein the heat sensitive composition additionally contains a phenolic substance which is solid at normal temperature and different from said acidic leuco dye and at least one basic chromogenic substance different from said amine derivative and capable of reacting with said phenolic substance at an elevated temperature to form a color, said amine derivative melting at a temperature higher or having a melting speed lower than said phenolic substance.

3. A heat sensitive recording sheet according to claim 1, wherein the acylated dye is an acylated xanthene or triphenylmethane lactone or sultone type acidic leuco dye.

4. A heat sensitive recording sheet according to claim 3, wherein the acylated dye is an acylated xanthene lactone type acidic leuco dye.

5. A heat sensitive recording sheet according to claim 2, wherein the heat sensitive composition is coated in at least one layer.

6. A heat sensitive recording sheet according to claim 2, wherein the basic chromogenic substance is selected from the group consisting of lactone, sultone, lactam and spiropyran type basic chromogenic substance.

7. A heat sensitive recording sheet according to claim 1, wherein the amine derivative is a guanidine derivative.

8. A heat sensitive recording sheet according to claim 4, wherein the xanthene dye is difficultly water soluble.

9. A heat sensitive recording sheet according to claim 2, wherein amount of the amine derivative is 10–900% of the phenolic substance.

10. A heat sensitive recording sheet according to claim 1, wherein the mixing ratio of the amine derivative to the acylated leuco dye is 1 : 1 – 1 : 50.

11. A heat sensitive recording sheet according to claim 2, wherein the mixing ratio of the phenolic substance to the basic chromogenic substance is 1 : 1 – 1 : 20.

12. A heat sensitive recording sheet according to claim 1, wherein the amine derivative has a melting point above 60° C.

13. A heat sensitive recording sheet according to claim 12, wherein the amine derivative has one of the formulae:

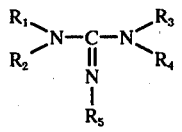

,

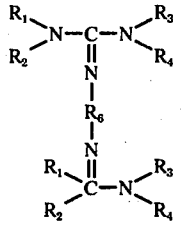

, or wherein:

$R_1$, $R_2$, $R_3$, $R_4$ and $R_5$ individually are hydrogen, alkyl having not over 18 carbon atoms, cycloalkyl, aryl, aralkyl, amino, alkylamino, acylamino, carbamoylamino, amidino, cyano or a heterocyclic, $R_6$ is lower alkylene, phenylene, naphthylene or

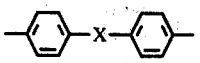

where X is lower alkylene, $SO_2$, $S_2$, S, O, —NH— or a single bond and where the aryl can be substituted by lower alkyl, alkoxy, nitro, acylamino, alkylamino or halogen and $R_7$, $R_8$ and $R_9$ individually are hydrogen, alkyl of not over 18 carbon atoms, aminoalkyl, cycloalkyl, aralkyl or heterocyclic or at least two of $R_7$, $R_8$ and $R_9$ bond to each other at a position other than N in the formula to form a ring together with N.

14. A heat sensitive recording sheet according to claim 13, wherein the phenolic substance is 4,4'-isopropylidene diphenol, 4,4'-isopropylidene bis(2-chlorophenol), 4,4'-isopropylidene bis(2-tert-butylphenol), 4,4'-sec-butylidenediphenol, 4,4'-(1-methyl-n-hexylidene)diphenol, 4-phenylphenol, 4-hydroxydiphenoxide, methyl-4-hydroxybenzoate, phenyl-4-hydroxybenzoate, 4-hydroxyacetophenol, salicylanilide, 4,4′-cyclohexylidenediphenol, 4,4′-cyclohexylidene bis(2-methylphenol), 4,4′-benzylidenediphenol, 4,4′-thio bis(6-tert-butyl-3-methylphenol), novalak type phenol resin, halogenated novolak type phenol resin, α-naphthol or β-naphthol.

15. A heat sensitive recording sheet according to claim 1 also comprising a phenolic substance solid at room temperature and different from said acidic leuco dye said amine derivative and said phenolic substance being in separate coating layers.

16. A heat sensitive recording sheet according to claim 15 wherein said separate coating layers are adjacent to each other.

17. A heat sensitive recording sheet according to claim 13 wherein the amine derivative has the formula

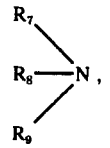

wherein $R_7$, $R_8$ and $R_9$ individually are hydrogen, alkyl of not over 18 carbon atoms, aminoalkyl, cycloalkyl, aralkyl or heterocyclic or at least two of $R_7$, $R_8$ and $R_9$ bond to each other at a position other than N in the formula to form a ring together. with N.

* * * * *